US009354574B2

(12) United States Patent
Bae et al.

(10) Patent No.: US 9,354,574 B2
(45) Date of Patent: May 31, 2016

(54) METHOD OF CONTROLLING PERFORMANCE OF AUTO COLOR REGISTRATION AND IMAGE FORMING APPARATUS USING THE SAME

(71) Applicant: Samsung Electronics Co., Ltd., Suwon-si (KR)

(72) Inventors: Hyo-joon Bae, Seoul (KR); Dong-sun Jung, Seoul (KR); Gun-ho Kim, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/532,467

(22) Filed: Nov. 4, 2014

(65) Prior Publication Data

US 2015/0125187 A1 May 7, 2015

(30) Foreign Application Priority Data

Nov. 4, 2013 (KR) ..... 10-2013-0132998

(51) Int. Cl.
*G03G 15/16* (2006.01)
*G03G 15/00* (2006.01)

(52) U.S. Cl.
CPC .... *G03G 15/5058* (2013.01); *G03G 2215/0135* (2013.01); *G03G 2215/0161* (2013.01)

(58) Field of Classification Search
CPC ..... G03G 15/1615; G03G 2215/0161; G03G 15/5058; G03G 15/0194; G03G 13/01; G03G 15/0126; G03G 2215/00059
See application file for complete search history.

(56) References Cited

U.S. PATENT DOCUMENTS

| | | | | |
|---|---|---|---|---|
| 8,184,338 | B2 | 5/2012 | Hur et al. | |
| 2008/0170277 | A1* | 7/2008 | Bae | H04N 1/506 358/504 |
| 2009/0027703 | A1* | 1/2009 | Kim | G03G 15/50 358/1.9 |
| 2009/0035030 | A1* | 2/2009 | Bae | H04N 1/00002 399/301 |
| 2010/0178069 | A1* | 7/2010 | You | G03G 15/5058 399/39 |
| 2010/0178083 | A1* | 7/2010 | Lee | G03G 15/0194 399/301 |

FOREIGN PATENT DOCUMENTS

KR 10-2010-0051402 5/2010

* cited by examiner

*Primary Examiner* — Francis Gray
(74) *Attorney, Agent, or Firm* — Staas & Halsey LLP

(57) ABSTRACT

A method of controlling performance of auto color registration (ACR) of a color image forming apparatus, and an image forming apparatus using the same are provided. The method of controlling performance of ACR includes forming a composite black image on a transfer belt, sensing the composite black image by using a sensor, measuring the sensed composite black image, and performing ACR correction when a measured width of the composite black image is greater than a previously set value. Accordingly, it is possible to prevent unnecessary performance of ACR control when no color misregistration has occurred. In this way, ACR control is performed in as short a time as possible so that performance of the image forming apparatus may be improved. Also, it is possible to prevent waste of ACR performance time and life span reduction of a driving source for ACR.

20 Claims, 10 Drawing Sheets

METHOD OF CONTROLLING PERFORMANCE OF AUTO COLOR REGISTRATION AND IMAGE FORMING APPARATUS USING THE SAME

CROSS-REFERENCE TO RELATED APPLICATIONS

This application claims the priority benefit of Korean Patent Application No. 10-2013-0132998, filed on Nov. 4, 2013, in the Korean Intellectual Property Office, the disclosure of which is incorporated herein in its entirety by reference.

BACKGROUND

1. Field

One or more embodiments relate to color registration of an image forming apparatus, and more particularly, to a method of controlling performance of auto color registration (ACR) of a color image forming apparatus in which it is determined whether or not an ACR control condition of the color image forming apparatus for printing an image on a recording medium, such as a color photocopier, a printer, a multifunction printer, etc., is satisfied, and an image forming apparatus using the same.

2. Description of the Related Art

A printing machine, such as a printer, a photocopier, etc., projects a light signal corresponding to image information onto a photosensitive body charged to a uniform potential by using an exposing unit (exposer) to form an electrostatic latent image, develops the electrostatic latent image by using a developing unit (developer) to form a toner image, transfers the toner image to a recording medium directly or through an intermediate medium, and applies pressure and heat to the toner image to fuse the toner image to the recording medium, thereby printing an image.

To print a color image, a color toner image is formed by overlapping yellow (Y), cyan (C), magenta (M), and black (K) toner. To provide a high-quality image, a color toner image in which toner images of the respective colors accurately overlap is formed by precisely controlling a printing process. To this end, detection and adjustment of a color registration error is necessary. Color-specific registration marks are formed on a recording medium. The color-specific registration marks are detected by using a sensor, and a color registration error is calculated by using the difference in detection time therebetween.

SUMMARY

One or more embodiments may include a method of controlling performance of auto color registration (ACR) of a color image forming apparatus in which a determination of whether or not color misregistration of the image forming apparatus occurs is made in real time to prevent unnecessary performance of ACR when no color misregistration of the image forming apparatus has occurred, and thus deterioration in printing performance caused by frequent ACR may be prevented.

One or more embodiments may include an image forming apparatus using the aforementioned method of controlling performance of ACR.

In an aspect of one or more embodiments, there is provided a method of controlling performance of ACR which includes forming a composite black image on a transfer belt; sensing the composite black image by using a sensor; measuring the sensed composite black image; and when a measured width of the composite black image is greater than a previously set value, performing ACR correction. The forming of the composite black image may include: examining whether a color image forming apparatus satisfies a previously set ACR correction condition; and when the color image forming apparatus satisfies the previously set ACR correction condition, forming the composite black image on the transfer belt. The ACR correction condition may be any one of a case where a temperature variation of a laser scanning unit (LSU) of the color image forming apparatus is a predetermined temperature or more, a case where a previous ACR performance time is a predetermined time or more, a case where the color image forming apparatus is not operated and does not output a color image for a specific reference time or more, and a case where the color image forming apparatus successively outputs a specific reference number of color images or more. The ACR correction condition may be a case where power of the color image forming apparatus is turned on, or the color image forming apparatus is switched from a sleep mode to a normal mode.

The forming of the composite black image may include forming the composite black image on the transfer belt at predetermined periodic intervals.

The composite black image may be formed by overlapping cyan (C), magenta (M), and yellow (Y), or cyan (C), magenta (M), yellow (Y), and black (K).

The composite black image may be formed on the transfer belt between sheets of paper, or in a blank space of a printing paper.

In an aspect of one or more embodiments, there is provided an image forming apparatus which includes: a transfer belt onto which a plurality of colors are transferred from a plurality of photosensitive bodies; a sensor which senses a toner pattern on the transfer belt; a control unit which performs control so that a composite black image is formed of a plurality of colors on the transfer belt; and a determination unit which measures a width of the composite black image sensed by the sensor, and determines whether the measured width of the composite black image is greater than a previously set value. When the determination unit determines that the measured width is greater than the previously set value, the control unit performs ACR correction.

The control unit may examine (determine) whether the image forming apparatus satisfies a previously set ACR correction condition, and perform control so that the composite black image is formed on the transfer belt when the image forming apparatus satisfies the previously set ACR correction condition.

The ACR correction condition may be any one of a case where a temperature variation of an LSU of the image forming apparatus is a predetermined temperature or more, a case where a previous ACR performance time is a predetermined time or more, a case where the image forming apparatus is not operated and does not output a color image for a specific reference time or more, and a case where the image forming apparatus successively outputs a specific reference number of color images or more. The ACR correction condition may be a case where power of the image forming apparatus is turned on, or the image forming apparatus is switched from a sleep mode to a normal mode.

The composite black image may be formed on the transfer belt at predetermined periodic intervals.

The composite black image may be formed by overlapping cyan (C), magenta (M), and yellow (Y), or cyan (C), magenta (M), yellow (Y), and black (K).

The composite black image may be formed on the transfer belt between sheets of paper, or in a blank space of a printing paper.

In an aspect of one or more embodiments, there is provided at least one non-transitory computer readable medium storing computer readable instructions which when executed implement methods of one or more embodiments.

BRIEF DESCRIPTION OF THE DRAWINGS

These and/or other aspects will become apparent and more readily appreciated from the following description of embodiments, taken in conjunction with the accompanying drawings in which.

DETAILED DESCRIPTION

Figure 1:
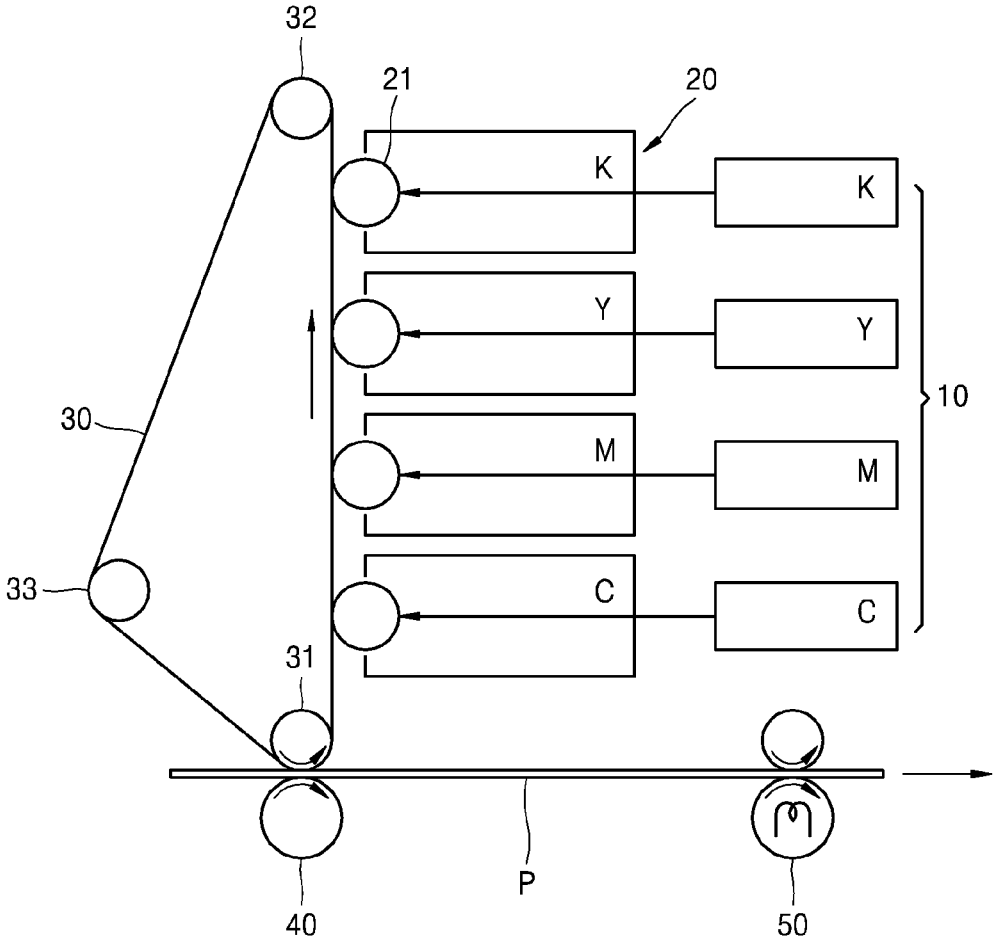
FIG. 1 is a diagram illustrating a process of supplying toner to a developing unit during a printing operation in an image forming apparatus.

Reference will now be made in detail to embodiments, examples of which are illustrated in the accompanying drawings, wherein like reference numerals refer to like elements throughout. Embodiments may have different forms and should not be construed as being limited to the descriptions set forth herein. Accordingly, embodiments are merely described below, by referring to the figures, to explain aspects of embodiments. As used herein, the term "and/or" includes any and all combinations of one or more of the associated listed items.

FIG. 1 is a diagram showing the constitution of an example of an image forming apparatus to which an embodiment is applied. Referring to FIG. 1, exposing units (electrostatic latent image forming portions) 10C, 10M, 10Y, and 10K, four developing units (developing portions) 20C, 20M, 20Y, and 20K in which yellow (Y), cyan (C), magenta (M), and black (K) toner is contained respectively, a transfer belt (transfer medium) 30, a transfer roller 40, and a fuser 50 are shown. The transfer belt 30 is supported by the support rollers 31, 32, and 33 and circularly moved. As the transfer medium, a drum-type transfer medium (not shown) may be used. Although not shown in detail in the drawing, the exposing units 100, 10M, 10Y, and 10K have polygon mirrors which deflect light emitted from a light source in a main scanning direction X, and reflective mirrors for adjusting the path of the deflected light.

The exposing unit 10C projects light corresponding to C image information to a photosensitive drum (photosensitive body) 21 of the developing unit 20C charged to a uniform potential, thereby forming an electrostatic latent image. The C toner contained in the developing unit 20C is attached to the electrostatic latent image so that a C toner image is formed. The C toner image is transferred to the transfer belt 30 by transfer bias applied to the transfer roller 40.

Next, the exposing unit 10M projects light corresponding to M image information to a photosensitive drum 21 of the developing unit 20M charged to a uniform potential, thereby forming an electrostatic latent image. The M toner contained in the developing unit 20M is attached to the electrostatic latent image so that an M toner image is formed. The M toner image is transferred to the transfer belt 30. Here, the operation starting time of the exposing unit 10M is controlled so that the M toner image is precisely transferred and superimposed on the C toner image when a head end of the C toner image arrives at a position where the photosensitive drum 21 of the developing unit 20M is in contact with the transfer belt 30.

Y and K toner images also transferred to the transfer belt 30 through the same process, and a color toner image in which the C, M, Y, and K toner images overlap is formed on the transfer belt 30. This color toner image is transferred to a paper P which is passed between the transfer roller 40 and the support roller 31. When the paper P passes through the fuser 50, the color toner image is fused to the paper P by heat and pressure, and color printing is completed.

Figure 2:
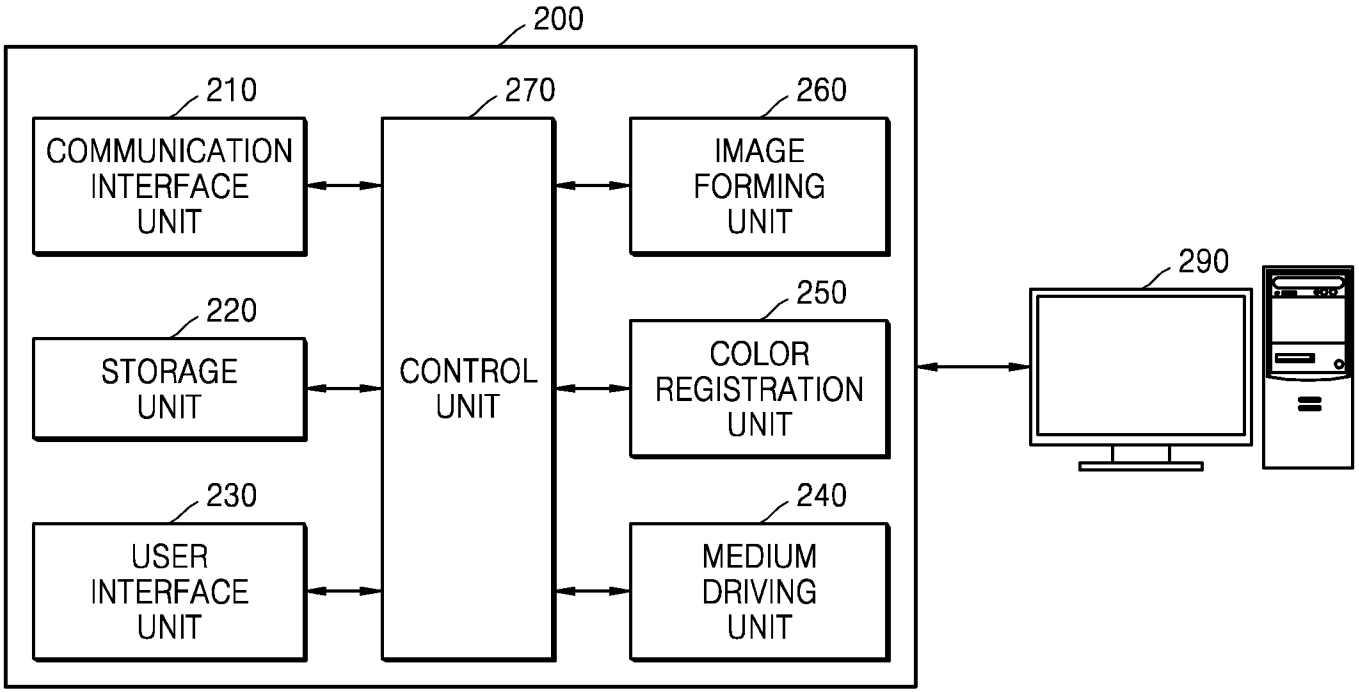
FIG. 2 is a block diagram showing an example of the constitution of a color image forming apparatus to which an embodiment is applied.

FIG. 2 is a block diagram showing an example of the constitution of a color image forming apparatus to which an embodiment is applied. Referring to FIG. 2, an image forming apparatus 200 may include a communication interface unit (communication interface) 210, a storage unit (storage) 220, a user interface unit (user interface) 230, a medium driving unit (medium driver) 240, a color registration unit (color register) 250, an image forming unit (image former) 260, and a control unit (controller) 270.

The communication interface unit 210 may be connected with a printing control terminal device 290, such as a personal computer (PC), a laptop PC, a personal digital assistant (PDA), a digital camera, portable media player (PMP), notebook computer, tablet, portable game player, wearable device, etc. The communication interface unit 210 is formed to connect the image forming apparatus 200 with an external device, and may be connected to the printing control terminal device 290 via a universal serial bus (USB) port as well as a local area network (LAN) or the Internet. Also, the communication interface unit 210 may be implemented to be connected to the printing control terminal device 290 in a wireless fashion as well as a wired fashion. The communication interface unit 210 may receive printing data from the printing control terminal device 290, and also receive an instruction to perform color registration from the printing control terminal device 290.

The storage unit 220 stores printing data, and may store the printing data received through the communication interface unit 210. The storage unit 220 may store history information about a print job performed by the image forming apparatus 200. Also, the storage unit 220 may be implemented as a storage medium in the image forming apparatus 200 or an external storage medium, for example, a removable disk including a USB memory, a web server based on a network, or so on.

The user interface unit 230 has a plurality of functional keys which enable a user to set or select various functions supported by the image forming apparatus 200, and displays various types of information provided by the image forming apparatus 200. The user interface unit 230 may be implemented as a device in which both an input and an output is made, such as a touch pad, or a device in which a mouse and a monitor are combined. By using a user interface window provided through the user interface unit 230, the user may input an instruction for the image forming apparatus 200 to perform color registration.

The medium driving unit 240 rotates an image forming medium. The medium driving unit 240 may drive image forming media on which an image is formed, such as an organic photoconductor (OPC), an intermediate belt (ITB), and a paper feeding belt.

The color registration unit 250 corrects color registration when color registration is necessary.

The image forming unit 260 forms an image, and may form an image on image forming media, such as an OPC, an ITB, and a paper feeding belt. Also, the image forming unit 260 may form a previously set mark for color registration correction on the image forming media.

The control unit 270 controls the respective components in the image forming apparatus 200. When printing data is received from the printing control terminal device 290, the control unit 270 may control the image forming unit 260 so that the received printing data is printed. Also, the control unit 270 may determine whether it is necessary to perform color registration. When it is determined that it is necessary to perform color registration, the control unit 270 may control the color registration unit 250 to perform color registration.

Figure 4:
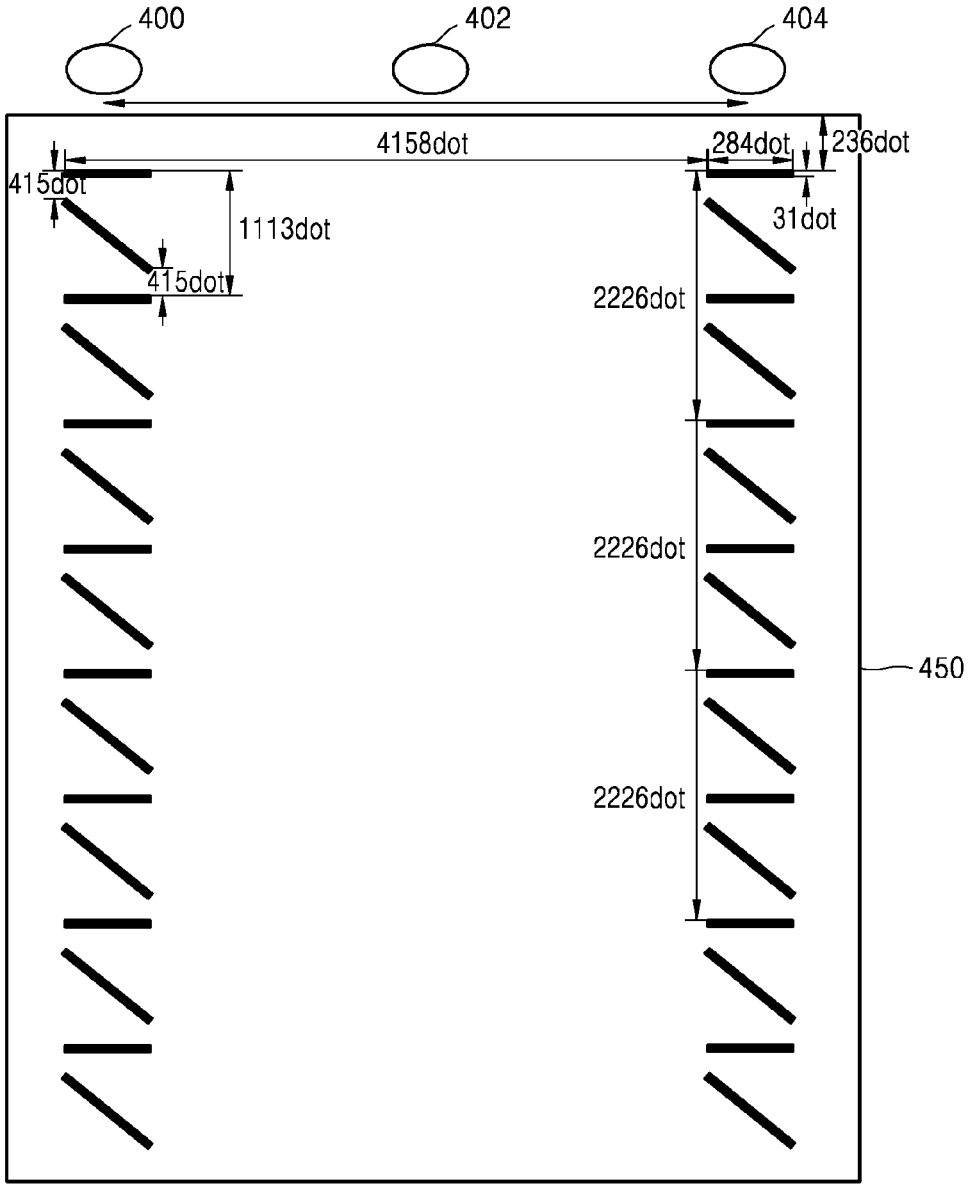
FIG. 4 shows an example of a measuring mark for general ACR control.

In the color image forming apparatus, color misregistration of an image may occur due to characteristics of devices (laser scanning unit (LSU) (laser scanner), ITB, OPC, etc.). To correct the color misregistration, an image color registration correcting operation is performed on the basis of a technique called auto color registration (ACR). This operation is performed by using predetermined measuring marks shown in FIG. 4, and color-specific correcting values are determined through the operation. FIG. 4 shows an example of a measuring mark for general ACR control. Reference numerals 400, 402, and 404 denote ACR sensors, and measuring marks on a transfer belt 450 may be changed. In general, when color misregistration occurs in a color image output by the color image forming apparatus, ACR control is performed by using the measuring marks of FIG. 4.

Examples of a case where color misregistration occurs in a color image output by the color image forming apparatus may include a case where color image printing is performed immediately after the replacement of a device, such as an LSU, etc., a case where a temperature difference of a temperature sensor installed in the color image forming apparatus is greater than a specific reference (in general, LSU temperature), a case where the color image forming apparatus is not operated and does not output a color image for a specific reference time or more, a case where the color image forming apparatus successively outputs a specific reference number of color images or more, a case where color misregistration occurs in the color image due to other unknown reasons, and so on.

Since the above-described cases result in color misregistration of a color image, these cases are called ACR correction conditions. When an ACR correction condition is satisfied, the color-specific correcting values are determined by using the measuring marks of FIG. 4, and thus color registration is corrected.

Table 1 shows ACR correction conditions and ACR control-performing states of a specific image forming apparatus. Among ACR control that was performed 12 times, the ACR control was performed 10 times according to the entry condition of a variation in LSU temperature, and was performed 2 times due to non-operation time. Printing states upon performing ACR control differ in all the 10 times that the ACR control was performed, and variations in LSU temperature may be determined to be severe.

TABLE 1

| Number of time | Entry condition | Printing state |
|---|---|---|
| 1 | 3 degrees of variation in LSU temperature | Single-sided printing on 9 sheets, and double-sided printing on 12 sheets is underway |
| 2 | 4 hours of non-operation time | — |
| 3 | 3 degrees of variation in LSU temperature | Single-sided printing on 21 sheets is underway |
| 4 | 3 degrees of variation in LSU temperature | Single-sided printing on 70 sheets is underway |
| 5 | 3 degrees of variation in LSU temperature | Single-sided printing on 126 sheets is underway |
| 6 | 4 hours of non-operation time | Not operated for 4 hours after single-sided printing on 83 sheets |
| 7 | 3 degrees of variation in LSU temperature | Single-sided printing on 144 sheets is underway |
| 8 | 3 degrees of variation in LSU temperature | Not operating |
| 9 | 3 degrees of variation in LSU temperature | Single-sided printing on 104 sheets, and double-sided printing on 3 sheets is underway |
| 10 | 4 hours of non-operation time | Not operated for 4 hours after single-sided printing on 100 sheets and double-sided printing on 6 sheets |
| 11 | 3 degrees of variation in LSU temperature | Single-sided printing on 37 sheets is underway |
| 12 | 3 degrees of variation in LSU temperature | Single-sided printing on 19 sheets is underway |

The LSU temperature was changed in the ACR control performed a total of 12 times, but it was impossible to know whether color misregistration had occurred in a color image actually output by the image forming apparatus.

In other words, the image forming apparatus performs ACR control even when it is determined that no color misregistration has actually been caused by the image forming apparatus according to the aforementioned ACR correction conditions. This may be a major factor which consumes ACR performance time and decreases the life span of a driving source for ACR.

Figure 3:
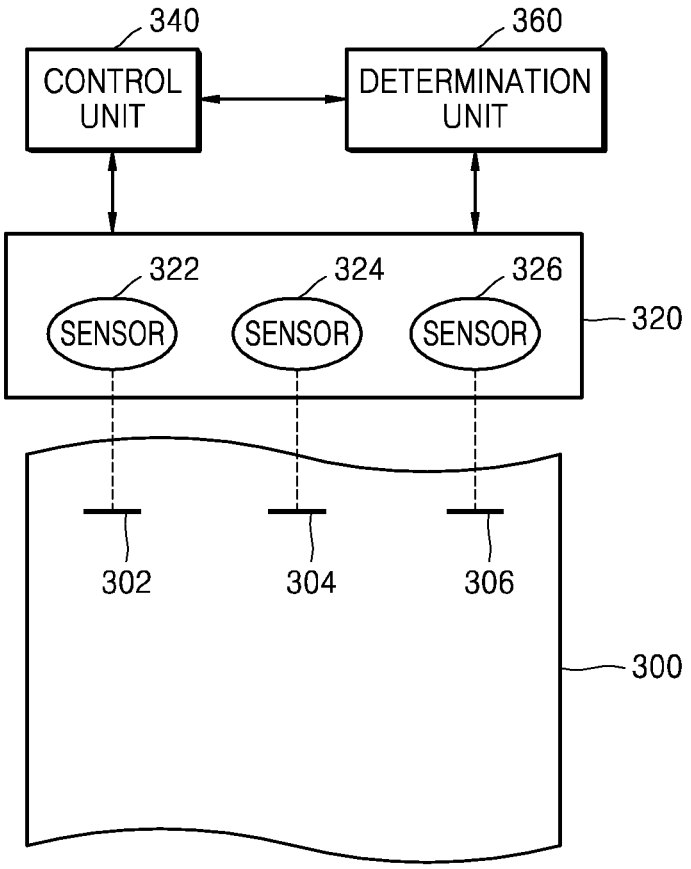
FIG. 3 is a block diagram showing the constitution of an image forming apparatus whose performance of auto color registration (ACR) may be controlled according to an embodiment.

FIG. 3 is a block diagram showing the constitution of an image forming apparatus whose performance of ACR may be controlled according to an embodiment. Referring to FIG. 3, the image forming apparatus whose performance of ACR may be controlled according to an embodiment includes a transfer belt 300, a sensor 320, a control unit (controller) 340, and a determination unit (determiner) 360.

As described in FIG. 1, an electrophotographic printer, such as a laser printer, which is an example of a color image forming apparatus includes four photosensitive bodies which are prepared to correspond to four colors of yellow, cyan, magenta, and black, an exposing unit which projects light to the respective photosensitive bodies to form electrostatic latent images of a desired image, a developing unit which develops the electrostatic latent images with developing solutions according to the respective colors, and an image forming medium (or transfer belt or intermediate belt) on which a completed color image is formed by sequentially transferring the images formed on the respective photosensitive bodies to overlap and which transfers the completed color image to a sheet of paper.

Therefore, to print one desired color image, a final color image is formed by developing images on the four photosensitive bodies according to the respective colors and transferring and superimposing the developed images at the same image position on a transfer belt, which is then printed on a sheet of paper.

The four colors are transferred onto the transfer belt 300 from a plurality of photosensitive bodies, that is, the four photosensitive bodies.

The sensor 320 senses toner patterns of the transfer belt 300, that is, composite black patterns in one or more embodiments.

The control unit 340 controls forming of images on the photosensitive bodies, and controls composite black images 302, 304, and 306 to be formed of a plurality of colors on the transfer belt 300. The determination unit 360 measures the widths of the composite black images 302, 304, and 306 sensed by sensors 322, 324, and 326, and determines whether the measured widths of the composite black images 302, 304, and 306 are greater than a predetermined value.

The control unit 340 performs ACR correction when the determination unit 360 determines that a width of a composite black image is greater than the predetermined value, and does not perform ACR correction when the determination unit 360 determines that a width of a composite black image is not greater than the predetermined value.

The control unit 340 examines (determines) whether the color image forming apparatus satisfies a predetermined ACR correction condition, and may perform control so that a composite black image is formed at a position that may be sensed by the sensor 320.

The ACR correction condition may be any one of a case where the temperature variation of an LSU of the color image forming apparatus is a predetermined temperature or more, a case where a previous ACR performance time is a predetermined time or more, a case where the color image forming apparatus is not operated and does not output a color image for a specific reference time or more, and a case where the color image forming apparatus successively outputs a specific reference number of color images or more. In addition, the ACR correction condition may include a case where the power of the color image forming apparatus is turned on, or a case where the color image forming apparatus is switched from a sleep mode to a normal mode.

Figure 5A:
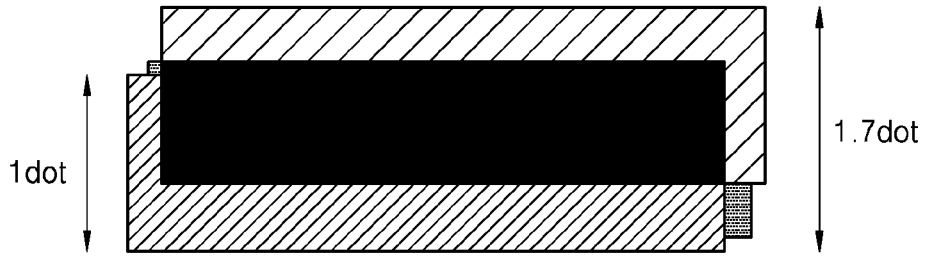
FIG. 5A shows a two-dimensional (2D) plan view of a composite black image.

The composite black image may be formed by overlapping cyan (C), magenta (M), and yellow (Y), or cyan (C), magenta (M), yellow (Y), and black (K). FIG. 5A shows a two-dimensional (2D) plan view of a composite black image, and FIG. 5B shows a three-dimensional (3D) perspective view of a composite black image.

Figure 5B:
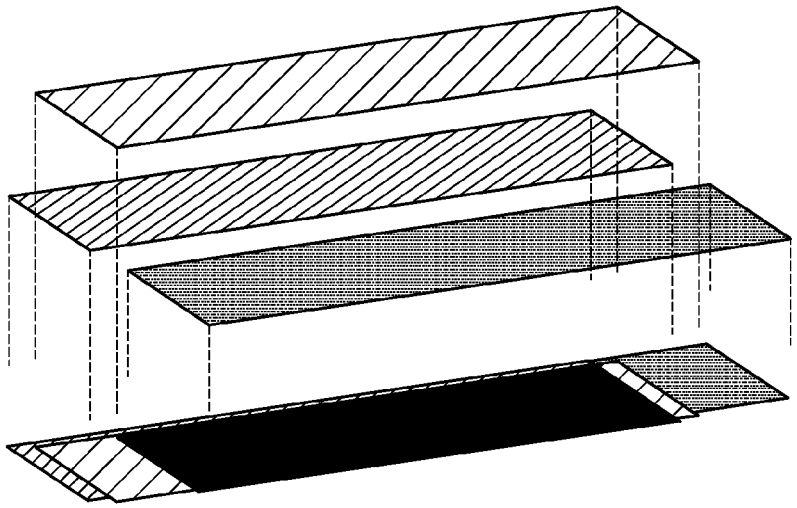
FIG. 5B shows a three-dimensional (3D) perspective view of a composite black image.

As shown in FIGS. 5A and 5B, a composite black image may be a black image which is output by mixing yellow, magenta and cyan toner rather than an image output by using black toner. Alternatively, a composite black image may be a black image which is output by mixing yellow, magenta, cyan, and black toner all together. The width of a composite black pattern which is output in this way is measured by using an ACR sensor.

Referring to FIG. 5A, the width of each color pattern is 1 dot, but the width sensed by the ACR sensor is 1.7 dots. Therefore, the largest relative error between color patterns is 1.7−1=0.7 (dots).

When a registration spec of a color image forming apparatus is 0.5 dots, the spec is not satisfied, and thus ACR control is performed to correct color registration of the image forming apparatus.

The sensors 322, 324, and 326 may sense a composite black image positioned on a transfer belt between sheets of paper or in a blank space of a printing paper.

Figure 6:
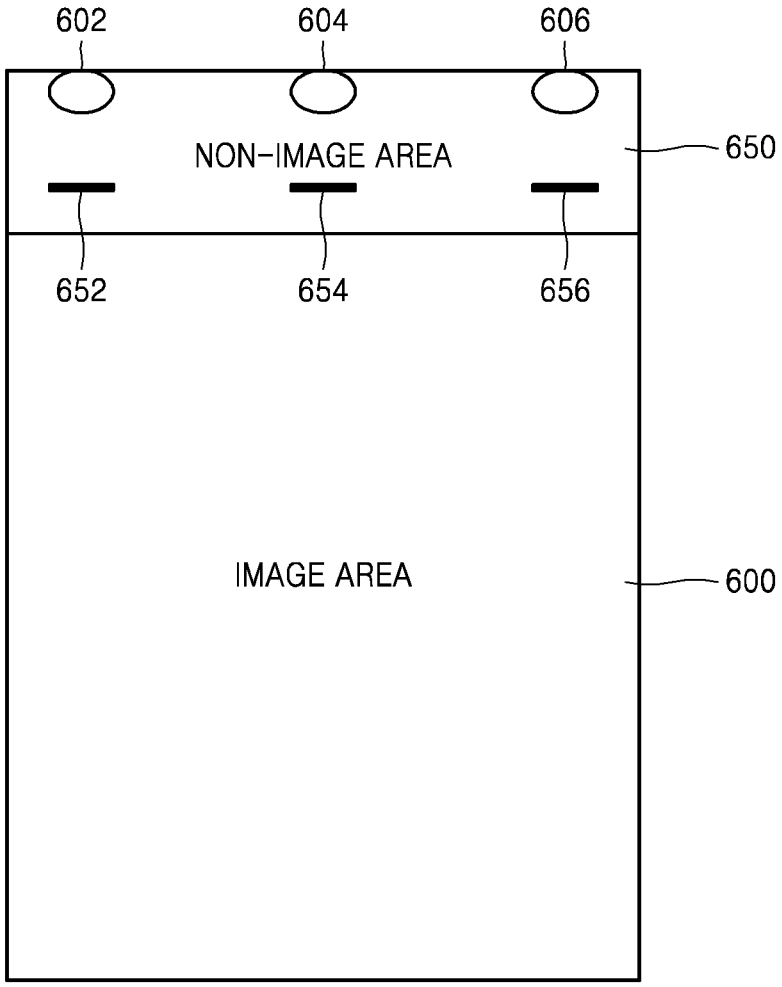
FIG. 6 shows composite black patterns in a non-image area.

FIG. 6 shows composite black patterns in a non-image area. Reference numerals 602, 604, and 606 denote ACR sensors. A non-image area 650 may be an area between sheets of paper. Referring to FIG. 6, in the non-image area 650 rather than an image area 600 in which an image is actually formed, composite black patterns 652, 654, and 656 may be output to determine whether or not to currently perform ACR control. Output of a composite black pattern in the non-image area 650 does not affect the printing performance of an image forming apparatus. In other words, the output does not reduce printing speed. The output of a composite black pattern in the non-image area 650 makes it possible not to perform unnecessary ACR correction by determining whether color misregistration has actually occurred. The image area 600 and the non-image area 650 of FIG. 6 may indicate an image area and a non-image area on a transfer belt.

As described above, a condition for determining whether or not to perform ACR control by using a composite black pattern in a non-image area includes a case where color image printing is performed immediately after the replacement of a device, such as an LSU, etc., a case where a temperature difference of a temperature sensor installed in the color image forming apparatus is greater than a specific reference (in general, LSU temperature), a case where the color image forming apparatus is not operated and does not output a color image for a specific reference time or more, a case where the color image forming apparatus successively outputs a specific reference number of color images or more, and a case where color misregistration occurs due to other unknown reasons.

Even when such a condition for determining whether or not to perform ACR control is satisfied, a composite black pattern formed in a non-image area makes it possible to determine whether color misregistration has actually occurred. Therefore, even when a condition for determining whether or not to perform ACR control is satisfied, ACR correction is not necessarily performed.

In addition, the control unit 340 may cause a composite black image to be formed at a position that may be sensed by the sensor 320 at predetermined periodic intervals. When a composite black pattern is formed in the non-image area 650 at periodic intervals, for example, once per 100 sheets, the determination of whether or not to perform ACR control by using the composite black patterns 652, 654, and 656 in the non-image area 650 may be made by determining whether color misregistration has actually occurred without performing ACR control unconditionally.

Figure 7:
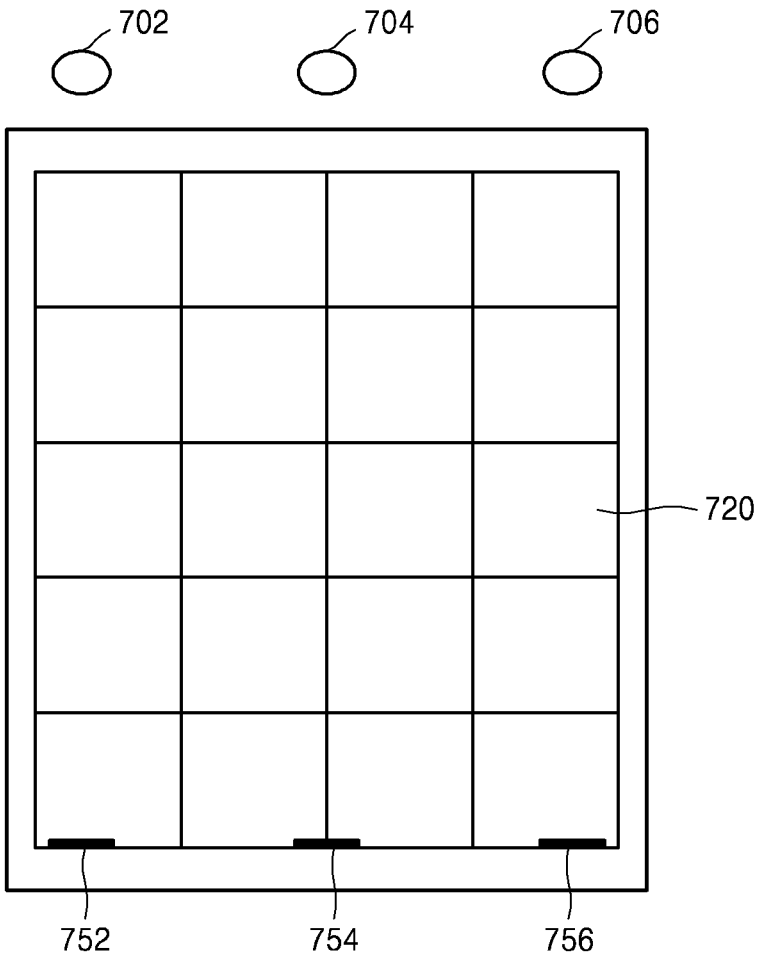
FIGS. 7 and 8 show composite black patterns formed in an image area.
Figure 8:
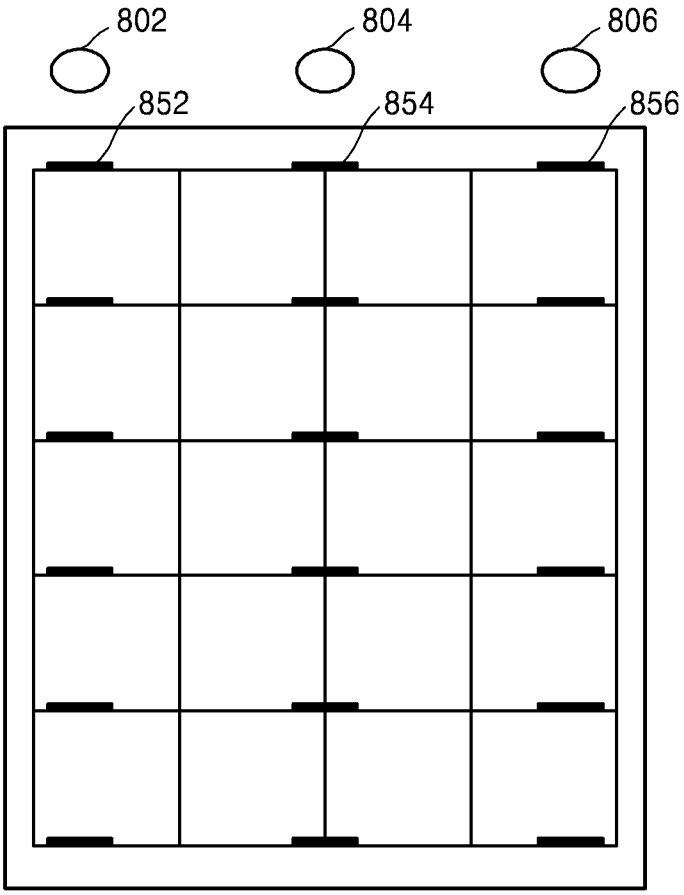

FIGS. 7 and 8 show composite black patterns formed in an image area.

The control unit 340 may cause a composite black pattern to be formed in an image area 720. When image formable data with which a composite black image may be formed, for example, a line or character, is in printing data, a composite black pattern may be formed on the line or character.

To this end, the control unit 340 includes an analysis portion which analyzes printing data, and performs control so that, when data with which an appropriate patch may be formed, for example, a line or character, is in printing data, image processing may be performed, and data related to the patch, for example, data that may be sensed by using an ACR sensor, may be output as a composite black pattern image.

The control unit 340 may cause only patch areas at positions that may be sensed by using the ACR sensors 702, 704, and 706 to be formed as composite black patterns 752, 754, and 756.

Alternatively, the control unit 340 may cause all areas of a main scanning line at the positions that may be sensed by using the ACR sensors 802, 804, and 806 to be formed as composite black patterns 852, 854, and 856. In this way, it is possible to prevent main scanning continuity from deteriorating when only the patch areas at the positions that may be sensed by using the ACR sensors 802, 804, and 806 are formed as composite black patterns 853, 854, and 856 and there is large patch misregistration.

The control unit 340 includes the analysis portion which analyzes printing data, and may cause a composite black pattern to be formed at a position on a paper even when data with which an appropriate patch may be formed, for example, a line or character, is not in printing data.

Figure 9:
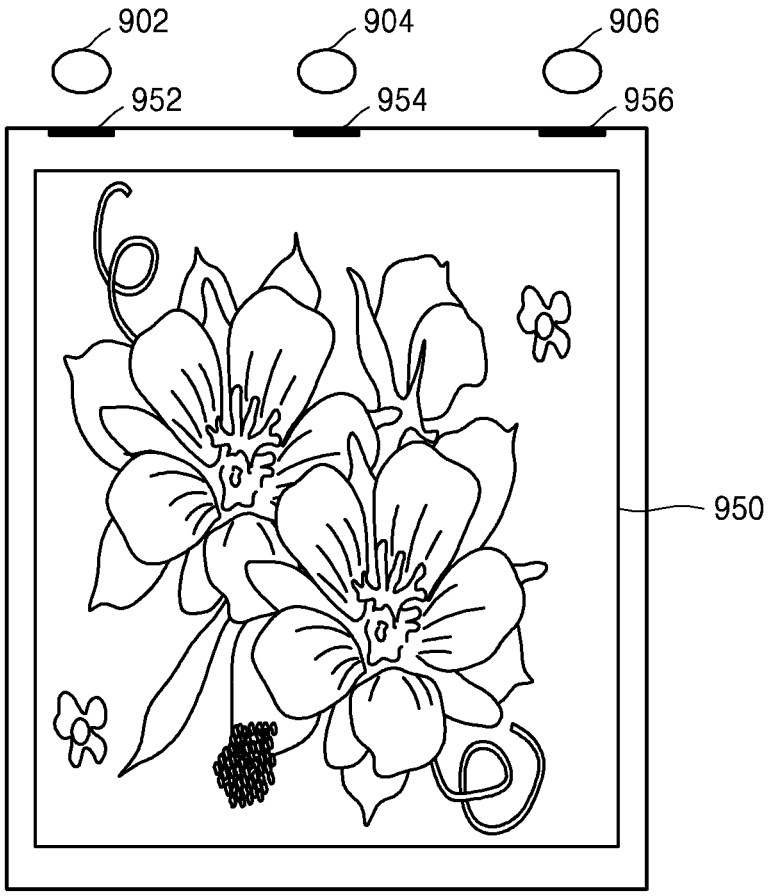
FIG. 9 shows composite black patterns formed at specific positions in a paper.

When a result of analyzing printing data through the analysis portion of the control unit 340 indicates that it is impossible to form an appropriate patch from the printing data for a predetermined time, as shown in FIG. 9, composite black patterns 952, 954, and 956 may be formed at an edge of a paper for accuracy and sensed by using ACR sensors 902, 904, and 906 to determine whether to perform ACR control. FIG. 9 also shows an image area 950.

An apparatus for determining color misregistration of an image forming apparatus according to an embodiment may include a sensor 320, a control unit 340, and a determination unit 360.

Sensors 322, 324, and 326 sense a toner pattern of a transfer belt 300 onto which a plurality of colors are transferred from a plurality of photosensitive bodies. The control unit 340 performs control so that a composite black image is formed of a plurality of colors on the transfer belt 300. The determination unit 360 measures the width of the composite black image sensed by the sensor 320, and determines whether the measured width of the composite black image is greater than a predetermined value. When the determination unit 360 determines that the width of the composite black image is greater than the predetermined value, the control unit 340 performs ACR correction.

Figure 10:
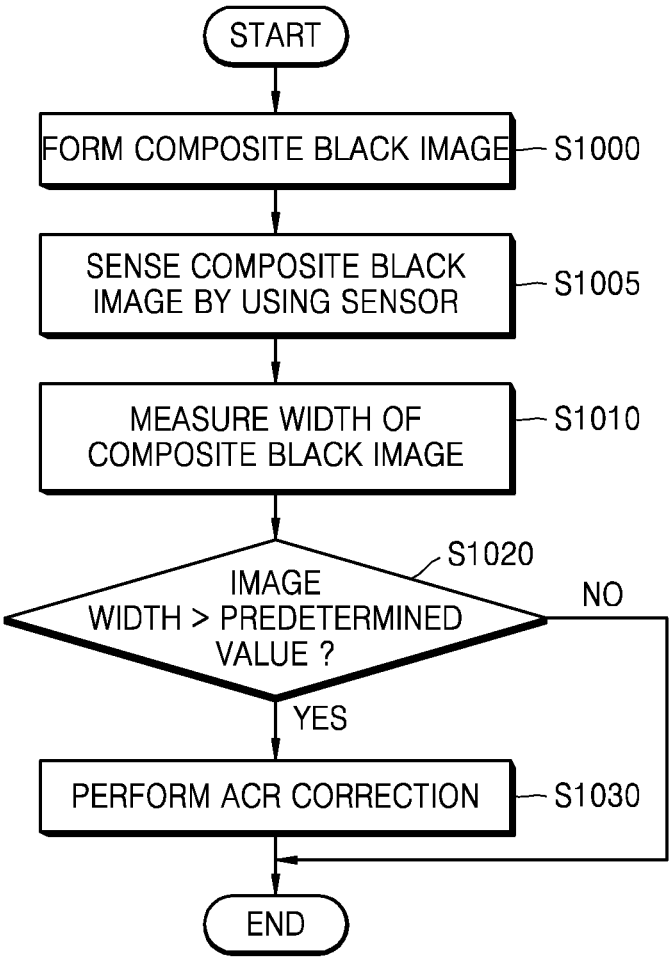
FIG. 10 is a flowchart illustrating a method of controlling performance of ACR according to an embodiment.

FIG. 10 is a flowchart illustrating a method of controlling performance of ACR according to an embodiment. Referring to FIG. 10, the control unit 340 causes forming of a composite black image on a transfer belt (S1000). The composite black image is sensed by the sensor 320 (S1005).

The control unit 340 may examine (determine) whether the forming of the composite black image corresponds to a previously set ACR correction condition, and then form the composite black image at a position that may be sensed by a sensor, for example, a transfer belt, when the forming of the composite black image corresponds to the ACR correction condition.

The ACR correction condition may be any one of a case where the temperature variation of an LSU of a color image forming apparatus is a predetermined temperature or more, a case where a previous ACR performance time is a predetermined time or more, a case where the color image forming apparatus is not operated and does not output a color image for a specific reference time or more, and a case where the color image forming apparatus successively outputs a specific reference number of color images or more. In addition, the ACR correction condition may be satisfied when the power of the color image forming apparatus is turned on, or the color image forming apparatus is switched from a sleep mode to a normal mode.

In another example, at predetermined periodic intervals, a composite black image may be formed at a position that may be sensed by a sensor, for example, the transfer belt.

An example of the composite black image may be formed by overlapping cyan (C), magenta (M), and yellow (Y). Another example of the composite black image may be formed by overlapping cyan (C), magenta (M), yellow (Y), and black (K).

The determination unit 360 measures the width of the composite black image (S1010). Subsequently, the determination unit 360 checks whether the width of the image is greater than a predetermined size (S1020), and the control unit 340 performs ACR correction when the width is greater than the predetermined size (S1030). On the other hand, when the width is not greater than the predetermined size, the control unit 340 does not perform ACR correction.

The position that may be sensed by a sensor may be a gap between sheets of paper on a composite black image transfer belt or a blank space of a printing paper. When image formable data with which a composite black image may be formed, for example, a line or character, is in printing data, a composite black pattern may be formed on the line or character.

The control unit 340 includes an analysis portion which analyzes printing data when image formable data with which a composite black image may be formed, for example, a line or character, is not in printing data. Even when data with which an appropriate patch may be formed, for example, a line or character, is not in printing data, image processing may be performed, and the control unit 340 may cause a composite black pattern to be formed at a position on a paper. When a result of analyzing printing data through the analysis portion of the control unit 340 indicates that it is impossible to form an appropriate patch from the printing data for a predetermined time, as shown in FIG. 9, the composite black patterns 952, 954, and 956 may be formed at an edge of a paper for accuracy and sensed by using the ACR sensors 902, 904, and 906 to determine whether to perform ACR control As described above, in a method of controlling performance of ACR and an image forming apparatus using the method according to the one or more embodiments, unnecessary ACR may be prevented from being performed when no color misregistration has occurred. In this way, ACR control is performed in as short a time as possible, and thus the performance of the image forming apparatus may be improved.

In addition, it is possible to prevent consumption of ACR performance time and life span reduction of a driving source which is driven for ACR. In other words, it is possible to reduce a waiting time (ACR performance time) during or immediately before a user's printing, reduce toner consumption by preventing output of a measuring mark for unnecessary ACR control, and prevent the life spans of parts from being reduced by unnecessary driving of an apparatus, such as an OPC, an ITB, etc., for ACR control.

When an entry condition is satisfied, even if no color misregistration has actually occurred, ACR of the related art involves performing ACR control, thereby causing deterioration in printing performance. On the other hand, in one or more embodiments, a composite black image is formed and then sensed to calculate the largest color misregistration, and it is determined whether or not to perform ACR according to the largest color misregistration so that the number of times ACR is performed may be reduced while the quality of printing registration is maintained.

In addition, other embodiments can also be implemented through computer readable code/instructions in/on a medium, e.g., a computer readable medium, to control at least one processing element to implement any above described embodiment. The medium can correspond to any medium/media permitting the storage and/or transmission of the computer readable code.

Processes, functions, methods, and/or software in apparatuses described herein may be recorded, stored, or fixed in one or more non-transitory computer-readable media (computer readable storage (recording) media) that includes program instructions (computer readable instructions) to be implemented by a computer to cause one or more processors to execute (perform or implement) the program instructions. The media may also include, alone or in combination with the program instructions, data files, data structures, and the like. The media and program instructions may be those specially designed and constructed, or they may be of the kind well-known and available to those having skill in the computer software arts. Examples of non-transitory computer-readable media include magnetic media, such as hard disks, floppy disks, and magnetic tape; optical media such as CD ROM disks and DVDs; magneto-optical media, such as optical disks; and hardware devices that are specially configured to store and perform program instructions, such as read-only memory (ROM), random access memory (RAM), flash memory, and the like. Examples of program instructions include machine code, such as produced by a compiler, and files containing higher level code that may be executed by the computer using an interpreter. The program instructions may be executed by one or more processors. The described hardware devices may be configured to act as one or more software modules that are recorded, stored, or fixed in one or more non-transitory computer-readable media, in order to perform the operations and methods described above, or vice versa. In addition, a non-transitory computer-readable medium may be distributed among computer systems connected through a network and program instructions may be stored and executed in a decentralized manner. In addition, the computer-readable media may also be embodied in at least one application specific integrated circuit (ASIC) or Field Programmable Gate Array (FPGA).

It should be understood that the exemplary embodiments described herein should be considered in a descriptive sense only and not for purposes of limitation. Descriptions of features or aspects within each embodiment should typically be considered as available for other similar features or aspects in other embodiments.

While one or more embodiments have been described with reference to the figures, it will be understood by those of ordinary skill in the art that various changes in form and details may be made therein without departing from the spirit and scope of the present disclosure as defined by the following claims and their equivalents.

What is claimed is:

1. A method of controlling performance of auto color registration (ACR), the method comprising:

forming a composite black image on a transfer belt;

sensing the composite black image by using a sensor;

measuring the sensed composite black image; and when a measured width of the composite black image is greater than a predetermined value, regardless of a previously set ACR correction condition, performing ACR correction.

2. The method of claim 1, wherein the forming of the composite black image comprises:

examining whether a color image forming apparatus satisfies the previously set ACR correction condition; and when the color image forming apparatus satisfies the previously set ACR correction condition, forming the composite black image on the transfer belt.

3. The method of claim 2, wherein the ACR correction condition is any one of a case where a temperature variation of a laser scanning unit (LSU) of the color image forming apparatus is a predetermined temperature or more than the predetermine temperature, a case where a previous ACR performance time is a predetermined time or more than the predetermined time, a case where the color image forming apparatus is not operated and does not output a color image for a specific reference time or more than a specific reference time, and a case where the color image forming apparatus successively outputs a specific reference number of color images or more than the specific reference number of color images.

4. The method of claim 2, wherein the ACR correction condition is a case where power of the color image forming apparatus is turned on, or the color image forming apparatus is switched from a sleep mode to a normal mode.

5. The method of claim 1, wherein the forming of the composite black image includes forming the composite black image on the transfer belt at predetermined periodic intervals.

6. The method of claim 1, wherein the composite black image is formed by overlapping cyan (C), magenta (M), and yellow (Y), or cyan (C), magenta (M), yellow (Y), and black (K).

7. The method of claim 1, wherein the composite black image is formed on the transfer belt between sheets of paper, or in a blank space of a printing paper.

8. The method of claim 1, wherein the composite black image is formed on a line or character in printing data.

9. The method of claim 1, further comprising, when the measured width of the composite black image is not greater than the predetermined value, performing no ACR correction.

10. An image forming apparatus comprising:

a transfer belt onto which a plurality of colors are transferred from a plurality of photosensitive bodies;

a sensor which senses a toner pattern on the transfer belt;

a control unit which controls the image forming apparatus so that a composite black image is formed of a plurality of colors on the transfer belt; and a determination unit which measures a width of the composite black image sensed by the sensor, and determines whether the measured width of the composite black image is greater than a predetermined value, wherein, when the determination unit determines that the measured width is greater than the predetermined value, regardless of a previously set ACR correction condition, the control unit performs auto color registration (ACR) correction.

11. The image forming apparatus of claim 10, wherein the control unit determines whether the image forming apparatus satisfies the previously set ACR correction condition, and controls the image forming apparatus so that the composite black image is formed on the transfer belt when the image forming apparatus satisfies the previously set ACR correction condition.

12. The image forming apparatus of claim 11, wherein the ACR correction condition is any one of a case where a temperature variation of a laser scanning unit (LSU) of the image forming apparatus is a predetermined temperature or more than the predetermined temperature, a case where a previous ACR performance time is a predetermined time or more than the predetermined time, a case where the image forming apparatus is not operated and does not output a color image for a specific reference time or more than the specific reference time, and a case where the image forming apparatus successively outputs a specific reference number of color images or more than the specific reference number of color images.

13. The image forming apparatus of claim 11, wherein the ACR correction condition is a case where power of the image forming apparatus is turned on, or the image forming apparatus is switched from a sleep mode to a normal mode.

14. The image forming apparatus of claim 10, wherein the composite black image is formed on the transfer belt at predetermined periodic intervals.

15. The image forming apparatus of claim 10, wherein the composite black image is formed by overlapping cyan (C), magenta (M), and yellow (Y), or cyan (C), magenta (M), yellow (Y), and black (K).

16. The image forming apparatus of claim 10, wherein the composite black image is formed on the transfer belt between sheets of paper, or in a blank space of a printing paper.

17. The image forming apparatus of claim 10, wherein the composite black image is formed on a character or line in printing data.

18. The image forming apparatus of claim 10, wherein the control unit does not perform ACR correction when the determination unit determines that the measured width of the composite black image is smaller than the predetermined value.

19. An apparatus for determining color misregistration of an image forming apparatus, comprising:

a sensor which senses a toner pattern on a transfer belt onto which a plurality of colors are transferred;

a control unit which controls the image forming apparatus so that a composite black image is formed of a plurality of colors on the transfer belt; and a determination unit which measures a width of the composite black image sensed by the sensor, and determines whether the measured width of the composite black image is greater than a predetermined value, wherein, when the determination unit determines that the measured width is greater than the predetermined value, regardless of a previously set ACR correction condition, the control unit performs auto color registration (ACR) correction.

20. At least non-transitory computer readable medium storing computer readable instructions which when executed control at least one processor to implement a method of claim 1.

* * * * *